United States Patent [19]

Opresco

[11] Patent Number: 4,757,999

[45] Date of Patent: Jul. 19, 1988

[54] PNEUMATICALLY OPERATED TOY DEVICE

[75] Inventor: Ovidiu Opresco, New York, N.Y.

[73] Assignee: Pressman Toy Corporation, New York, N.Y.

[21] Appl. No.: 907,838

[22] Filed: Sep. 15, 1986

[51] Int. Cl.[4] ..... A63F 9/04; A63B 71/00; A63D 3/02; A63D 13/00

[52] U.S. Cl. ..... 273/145 CA; 273/129 AB; 273/144 B; 273/138 R

[58] Field of Search ..... 273/145 CA, 145 D, 145 R, 273/145 C, 144, 85 H, 108, 119 B, 340, 357, 129 AP; 446/176, 186, 198, 3, 486; 124/61, 64

[56] References Cited

U.S. PATENT DOCUMENTS

| | | | |
|---|---|---|---|
| 177,438 | 5/1876 | Thorne | 273/145 D |
| 178,537 | 6/1876 | Macintire | 273/145 D |
| 409,701 | 8/1889 | Phillips | 446/198 |
| 485,709 | 11/1892 | Parker | 273/145 D |
| 1,766,134 | 6/1930 | Lauterbach | 273/145 D |
| 2,170,373 | 8/1939 | Kind | 273/85 H |
| 2,919,921 | 1/1960 | Berger | 446/3 |
| 3,356,369 | 12/1967 | Stubbmann | 273/145 |
| 3,711,097 | 1/1973 | Begley | 273/357 |
| 4,468,029 | 8/1984 | Kulesza | 273/129 AP |
| 4,513,967 | 4/1985 | Halford et al. | 273/108 |

FOREIGN PATENT DOCUMENTS

| | | | |
|---|---|---|---|
| 18717 | 1/1882 | Fed. Rep. of Germany | 273/145 R |
| 9104 | of 1904 | United Kingdom | 273/145 CA |
| 2129 | of 1906 | United Kingdom | 273/145 CA |
| 1482735 | 8/1977 | United Kingdom | 273/119 B |

*Primary Examiner*—Richard C. Pinkham
*Assistant Examiner*—Mark S. Graham
*Attorney, Agent, or Firm*—Henry R. Lerner

[57] ABSTRACT

A peumatically operated playing device for randomly casting at least one discrete article includes a substantially rigid cubic enclosure having a first opening on one wall thereof and a second opening on another wall thereof; a first elastic membrane covering the first opening; a second elastic membrane covering the second opening; a retraction element on the first elastic membrane for retracting the first elastic membrane; and the substantially rigid enclosure and the first and second elastic membranes defining a hermetically sealed chamber within the substantially rigid enclosure, such that retraction of the first elastic membrane results in a consequent retraction of the second elastic membrane, and subsequent release of the first elastic membrane causes the second elastic membrane to impart a force to any discrete articles which may be positioned in engagement with the second elastic membrane. The device is easily adapted to a randomizer for a dice game, a lottery game, a tic-tac-toe game, and other games where dice are cast.

3 Claims, 4 Drawing Sheets

PNEUMATICALLY OPERATED TOY DEVICE

BACKGROUND OF THE INVENTION

The present invention relates generally to playing devices, and more particularly, is directed to a pneumatically operated playing device for randomly casting at least one discrete article.

Many devices are known for randomly casting a pair of dice. These devices, however, generally use some form of mechanical actuation of the device or of a supporting surface on which the dice are positioned. For example, some of these devices provide an elastic supporting surface for the dice, and the elastic supporting surface is grasped and then released, as shown in U.S. Pat. No. 177,438. Other devices disclose impacting the elastic supporting surface by a hammer, as shown in U.S. Pat. No. 178,537.

Another example of a known device for randomly casting a die is disclosed in U.S. Pat. No. 3,356,369, which has a spring element with an upper surface on which a die rests. The spring element can be depressed by a transparent cover, and when released, the spring element pops up the die to randomly cast the same.

With all of such devices, however, a separate mechanical actuating assembly must be provided, thereby adding to the complexity and cost of the device.

U.S. Pat. No. 485,709 discloses a pneumatically operated die caster. In this device, a die is positioned on a support surface, and a chamber is connected to the underside of the support surface through a conduit. The chamber is open at the bottom to receive air. A plunger is positioned in the chamber and is normally biased upwardly by a spring. When the plunger is depressed against the force of the spring, air is displaced by the plunger and flows through the conduit to impart a force to the die support surface, and thereby cause the die to be randomly cast. When the plunger is released, the spring returns it to its initial position, and at the same time, air is drawn into the chamber at the bottom thereof. However, since this device requires a separate plunger and spring, it also is relatively complex and costly.

Other devices which use a pneumatic actuator for propelling a ball, a car of the like are disclosed in U.S. Pat. Nos. 2,170,373; 4,468,029; and 4,513,967. These devices, however, use a plunger similar to that of U.S. Pat. No. 485,709, and therefore suffer from the same deficiencies. See also U.S. Pat. No. 3,711,097.

The above deficiencies in known devices are not limited to die casting devices. For example, such deficiencies apply to many other devices, such as in apparatus for randomly selecting numbers in a lottery game, in which a plurality of balls are randomly cast.

OBJECTS AND SUMMARY OF THE INVENTION

Accordingly, it is an object of the present invention to provide a novel pneumatically operated playing device for randomly casting at least one discrete article.

More particularly, it is an object of the present invention to provide a pneumaticllly operated device for randomly casting at least one die, ball or the like.

It is another object of the present invention to provide a pneumatically operated device that does not require any mechanically actuating elements.

It is yet another object of the present invention to provide a pneumatically operated device that is relatively simple in construction and operation, and inexpensive to manufacture.

In accordance with an aspect of the present invention, a pneumatically operated playing device includes a substantially rigid enclosure haivng a first opening and a second opening; a first elastic membrane covering the first opening; a second elastic membrane covering the second opening; retraction means on the first elastic membrane for tracing the first elastic membrane; at least one discrete article associated with the second elastic membrane; and the substantially rigid enclosure and the first and second elastic membrane defining a hermetically sealed chamber, at atmospheric pressure, within the substantially rigid enclosure, such that retraction of the first elastic membrane results in a consequent retraction of the second elastic membrane, and release of the first elastic membrane causes the second elastic membrane to impart a force to the at least one discrete article.

The above and other objects, features and advantages of the present invention will become readily apparant from the following detailed description thereof which is to be read in connection with the accompanying drawings.

DETAILED DESCRIPTION OF THE PREFERRED EMBODIMENTS

Figure 1:
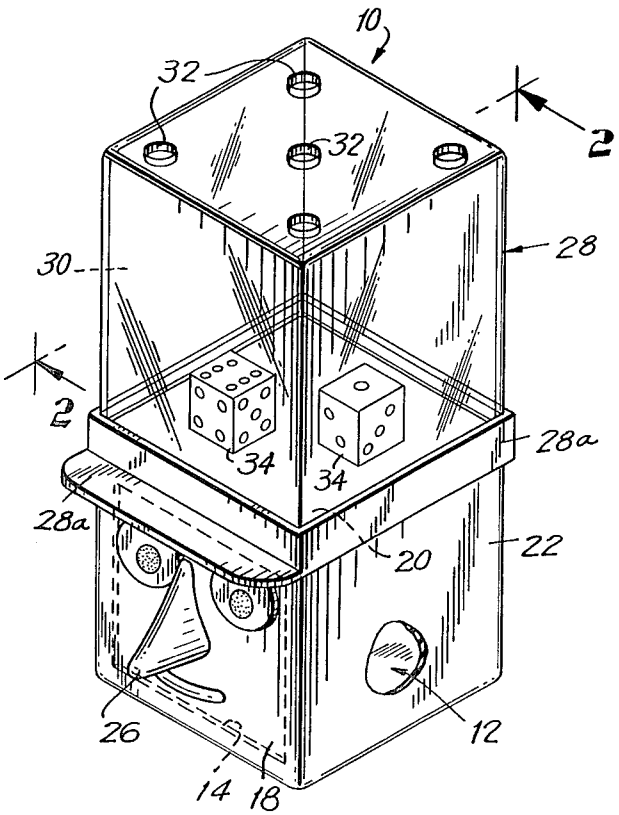
FIG. 1 is a perspective view of a pneumatically operated playing device according to one embodiment of the present invention.

Referring to the drawings in detail, and initially to FIG. 1 thereof, a pneumatically operated playing device 10 according to a first embodiment of the present invention includes a substantially rigid enclosure 12. Preferably, enclosure 12 is formed as a cube having four side walls, a bottom wall and a top wall. However, the present invention is not so limited, and enclosure 12 can take any other suitable form. For example, enclosure 12 can have a circular side wall, a horizontal top wall and a horizontal bottom wall.

In accordance with the present invention, one side wall **12*a* is open at least along a portion thereof to form a first opening 14, and in like manner, the upper horizontal wall 12*b* is open at least along a portion thereof to form a second opening 16. A first elastic membrane 18 is positioned in covering relation to first opening 14, and a second elastic membrane 20 is positioned in covering relation to second opening 16**.

As an example, and as shown, a sheet of elastic material 22 can be stretched over enclosure 12 and secured to bottom wall 12*c* thereof by a suitable adhesive, and a protective piece of felt, foam or the like 23 can then be secured on the adhered elastic sheet 22. In such case, the portion of elastic sheet 22 extending over first opening 14 constitutes first elastic membrane 18, and the portion of elastic sheet 22 extending over second opening 16 constitutes second elastic membrane 20. Elastic sheet 22 can be made of any suitable material, such as rubber or the like. With elastic sheet 22 secured about enclosure 22, a hermetically sealed chamber 24 is defined with enclosure 12, at atmospheric pressure, which is an important aspect of the present invention.

Figure 2:
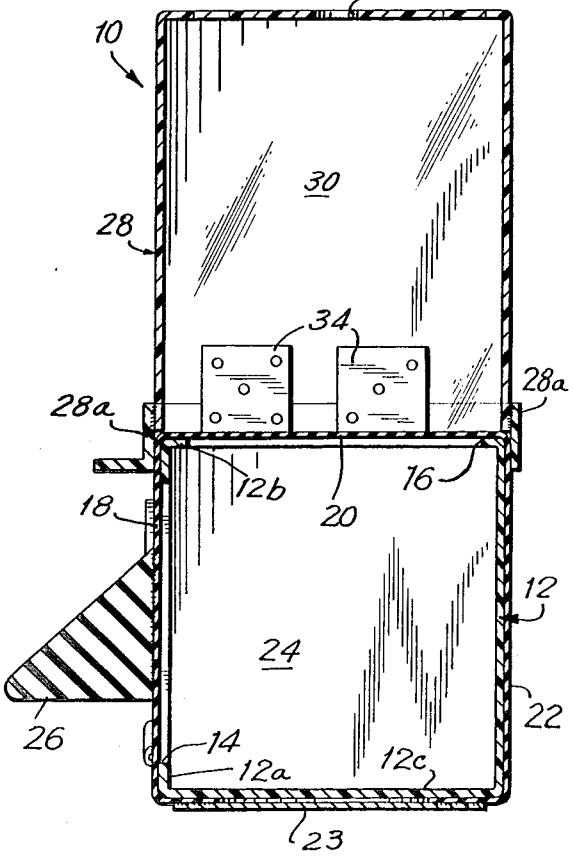
FIG. 2 is a cross-sectional view of the playing device of FIG. 1, taken along line 2—2 thereof.
Figure 3:
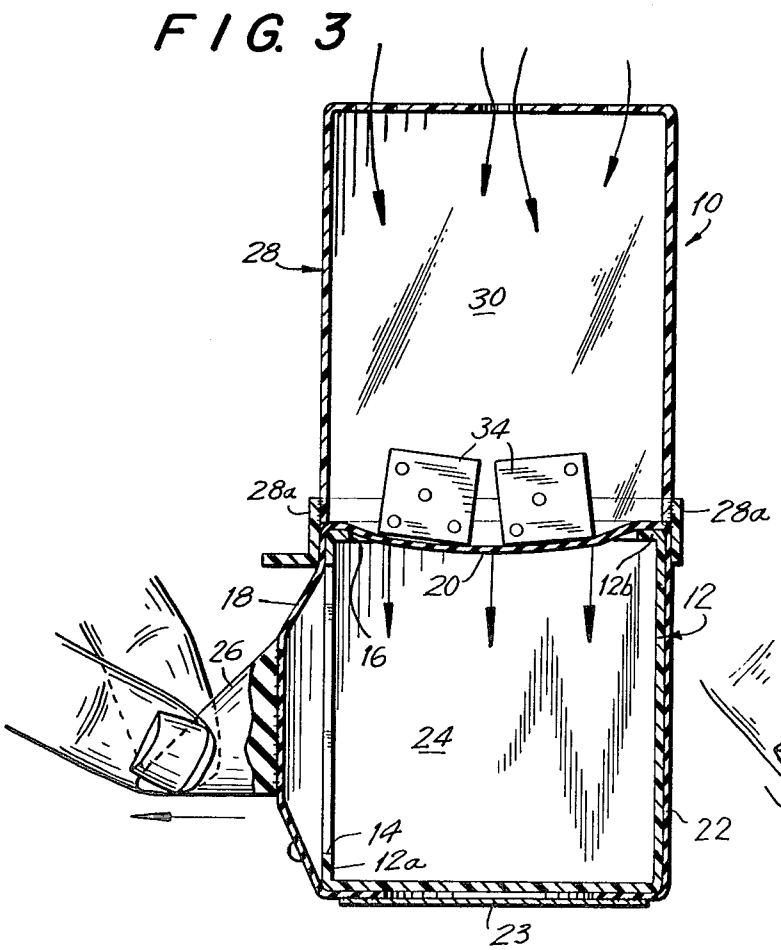
FIG. 3 is a cross-sectional view of the playing device of FIG. 2, showing the first elastic membrane in a retracted position.

In accordance with the present invention, it is necessary to provde for retraction of first elastic membrane 18, as shown in FIG. 3. In this regard, a retraction device 26 is secured to first elastic membrane 18 for pulling the same outwardly. In the embodiment shown in FIGS. 1–4, retraction device 26 takes the form of a nose, which is part of a face design on first elastic membrane 18. However, the present invention is not limited to this type of retraction device 26.

A removable, transparent cover 28, made of plastic or other suitable material, is mounted on upper horizontal wall 12*b* of enclosure 12. More particularly, transparent cover 28 poreferably is formed as a cube, with the bottom wall thereof completely open. The dimensions of transparent cover 28 are equal to or slightly less than those of enclosure 12, such that cover 28 rests on top of enclosure 12, as shown in FIG. 2. To prevent lateral movement of cover 28, and to removably secure cover 28 on enclosure 12, cover 28 is formed with a circumferential lip 28*a* at the lower end, which hanges over and surrounds the upper end of enclosure 12.

When cover 28 is positioned on enclosure 12, a compartment 30 is defined therein. In accordance with the present invention, it is important that compartment 30 be at atmospheric pressure. Accordingly, a plurality of holes 32 are formed in cover 28 for this purpose. Lastly, at least one discrete article is positioned in compartment 30. In FIGS. 1–4, for example, discrete articles comprise a pair of dice 34 are positioned in compartment 30 on second elastic membrane 20.

Figure 4:
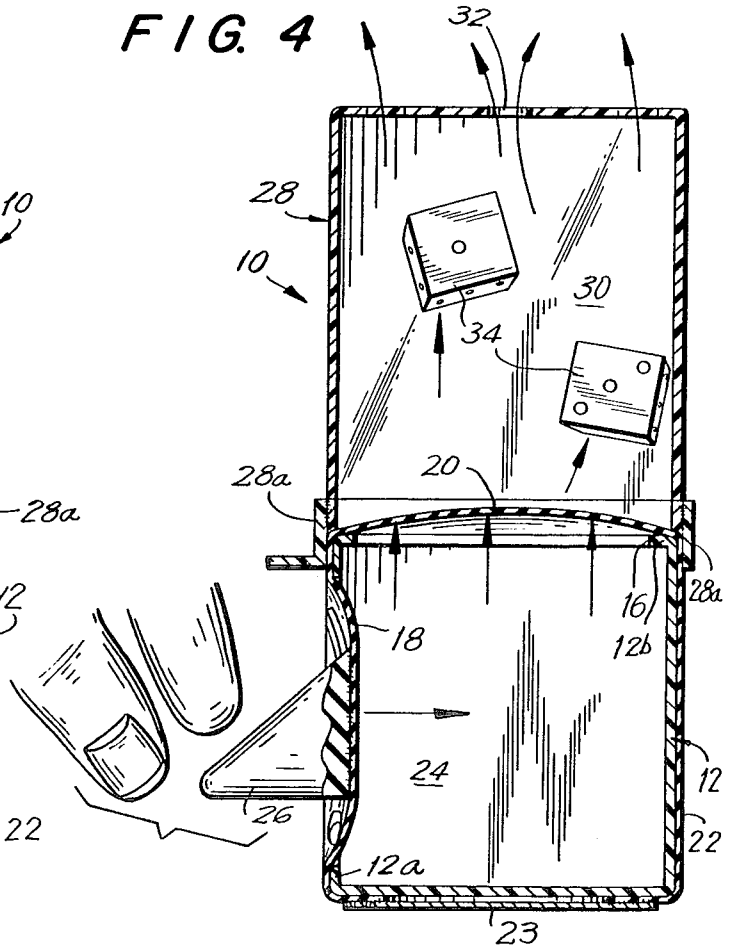
FIG. 4 is a cross-sectional view of the playing device of FIG. 2, showing the first elastic membrane in a released position after it has been retracted.

With the arrangement described above, retraction device 26 is pulled by the user, as shown in FIG. 3, thereby instantaneously enlarging the volume of chamber 24, causing an accompanying reduction of pressure within such chamber. This results in a difference in pressure on opposite sides of the second membrane 20, causing its retraction, as best shown in FIG. 3. Since dice 34 are positioned on second elastic membrane 20, they are displaced downwardly with second elastic membrane 20. When retraction device 26 is released, as shown in FIG. 4, because of the elastic nature of first elastic membrane 18, the latter is caused to move inwardly into chamber 24. This, in turn, causes second elastic member 20 to rapidly move in an upward direction, thereby throwing dice 34 upwardly to cast the same. Because second membrane 20 is made of an elastic material, when dice 34 land, they bounce on second elastic membrane, to further impart a randomness to the selection of the numbers on the dice 34.

Figure 6:
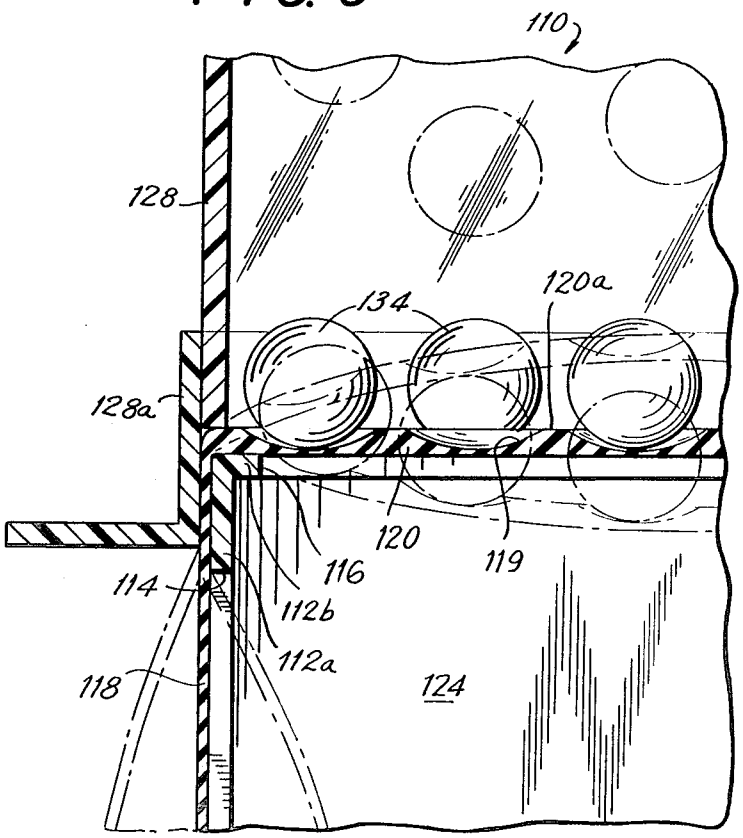
FIG. 6 is a cross-sectional view of a portion of the playing device of FIG. 5, taken along line 6—6 thereof.
Figure 5:
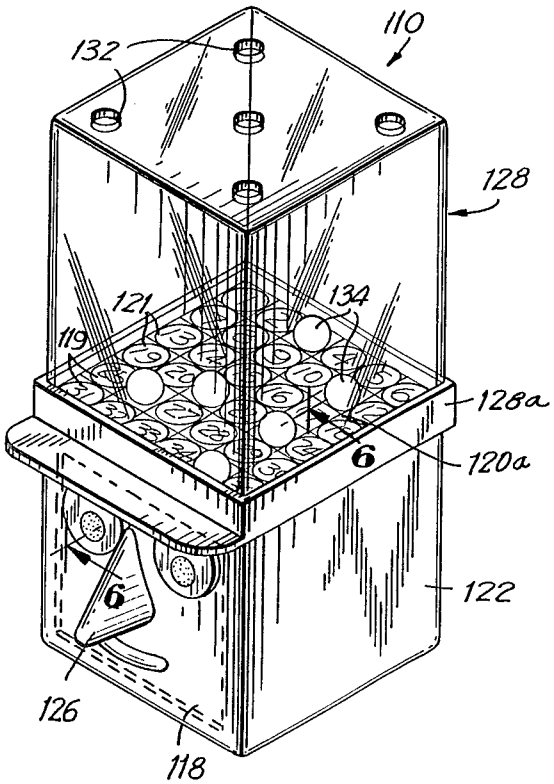
FIG. 5 is a perspective view of a pneumatically operated playing device according to a second embodiment of the present invention.

Referring now to FIGS. 5 and 6, there is shown a pneumatically operated playing device 110 according to a second embodiment of the present invention, in which elements identical to those of the first embodiment of FIGS. 1–4 are identified by the same numerals, augmented by 100, and a detailed description of such like elements will be omitted herein for the sake of brevity.

The difference between the embodiment of FIGS. 5 and 6 and the embodiment of FIGS. 1–4 is that upper surface 120*a* of second membrane 120*a* has a plurality of circular recesses 119 formed therein. Although thirty-six such recesses 119 are shown, the present invention is not so limited. In addition, different indicia markings 121, such as numerical indicia, are marked in recesses 119. Instead of dice 34, a plurality, for example, six, balls 134 are provided in compartment 130.

This embodiment of the present invention is designed to be used in conventional lottery type games. Specifically, the user pulls and then releases retraction device 126. As a result, balls 134 are randomly cast in compartment 130, and randomly fall within recesses 119, whereby the device 110 automatically and randomly picks six numbers 121 that can be used in the lottery game.

Figure 7:
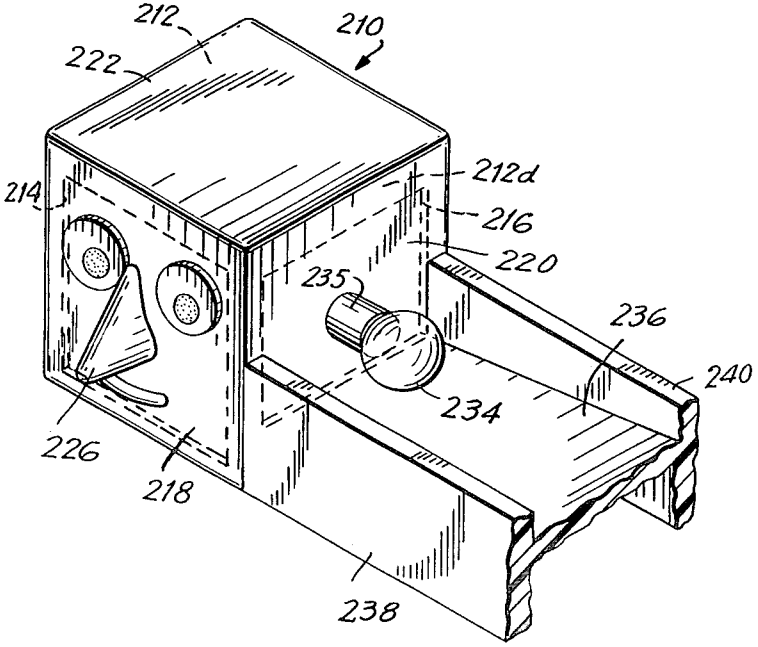
FIG. 7 is a perspective view of a pneumatically operated playing device according to a third embodiment of the present invention.

Referring now to FIG. 7, there is shown a pneumatically operated playing device 210 according to a third embodiment of the present invention, in which elements identical to those of the first embodiment of FIGS. 1–4 are identified by the same numerals, augmented by 200, and a detailed description of such like elements will be omitted herein for the sake of brevity.

The difference between the embodiment of FIG. 7 and the embodiment of FIGS. 1–4 is that second opening 216 is formed in another side wall 212*d* of enclosure 212, and second elastic membrane 220 covers such second opening 216. An actuating device 235 is secured to second elastic membrane 220. In one form of the invention, actuating device 235 is in the form of a short cylindrical member extending axially outward from second elastic membrane 220. A ramp 236 is positioned adjacent side wall 212*d* and has side walls 238 and 240, and a ball 234 is positioned on ramp 236 in contact with the free end of cylindrical actuating device 235.

In operation, when the user retracts and then releases first elastic membrane 218 through retraction device 226, cylindrical actuating device 235 pushes and/or impacts ball 234 to push it along ramp 236. This form of the invention has particular applicability in a billiards or bowling type game, where there are other balls or pins at the other end of the ramp 236.

Figure 8:
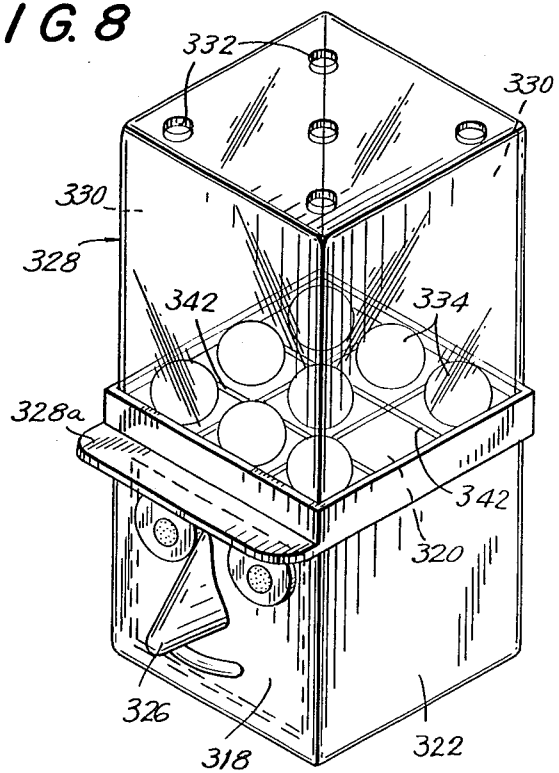
FIG. 8 is a perspective view of a pneumatically operated playing device according to a fourth embodiment of the present invention.

Referring now to FIG. 8, there is shown a pneumatically operated playing device 310 according to a fourth embodiment of the present invention, in which elements identical to those of the first embodiment of FIGS. 1–4 are identified by the same numerals, augmented by 300, and a detailed description of such like elements will be omitted herein for the sake of brevity.

The difference between the embodiment of FIG. 8 and the embodiment of FIGS. 1–4 is that a plurality of ribs 342 are provided on the upper surface of second elastic membrane 320 which divide such surface into a plurality of discrete sections. In this embodiment, flexible, raised ribs 342 divide the upper surface of second elastic membrane 320 into nine equal square sections in the form of a tic-tac-toe board. Eight balls 334 are provided on such upper surface and each ball 334 falls into one of the square sections. Four of the balls 334 are provided with one color, while the remaining four balls 334 have another color, such as black and white.

In operation, when retraction device 326 is pulled and then released, a force is imparted to balls 334 through second elastic membrane 320, and balls 334 are cast about in enclosure 330. Balls 334 then randomly fall within respective square sections divided by ribs 342. If three of the same color balls 334 are arranged in a horizontal, vertical or diagonal row of square sections, the player having that color wins.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope or spirit of the invention as defined in the appended claims.

What is claimed is:

1. A pneumatically operated playing device comprising:

a substantially rigid enclosure having a first opening and a second opening;

a first elastic membrane covering said first opening;

a second elastic membrane covering said second opening;

retraction means on said first elastic membrane for retracting said first elastic membrane; and said substantially rigid enclosure and said first and second elastic membrane defining a hermetically sealed chamber within said substantially rigid enclosure, such that retraction of said first elastic membrane results in a consequent retraction of said second elastic membrane, and subsequent release of said first elastic membrane causes said second elastic membrane to be suddenly restored to its initial position, whereby a sudden movement is imparted to any discrete article in engagement with said second membrane, the pressure within the hermetically sealed chamber being at atmospheric pressure, and said enclosure including at least an upper horizontal wall and a side wall, said first opening being formed in said side wall and said second opening being formed in said upper horizontal wall, at least one discrete article in engagement with said second membrane, and a transparent enclosure covering said second membrane and said at least one discrete article.

2. A pneumatically operated playing device according to claim 1 wherein said transparent cover includes at least one opening therein.

3. A pneumatically operated playing device comprising:

a substantially rigid enclosure having a first opening and a second opening;

a first elastic membrane covering said first opening;

a second elastic membrane covering said second opening;

retraction means on said first elastic membrane for retracting said first elastic membrane; and said substantially rigid enclosure and said first and second elastic membranes defining a hermetically sealed chamber within said substantially rigid enclosure, such that retraction of said first elastic membrane results in a consequent retraction of said second elastic membrane, and subsequent release of said first elastic membrane causes said second elastic membrane to be suddenly restored to its initial position, whereby a sudden movement is imparted to any discrete article in engagement with said second membrane, the pressure within the hermetically sealed chamber being at atmospheric pressure, and said enclosure including at least an upper horizontal wall and a side wall, said first opening being formed in said side wall and said second opening being formed in said upper horizontal wall, at least one discrete article comprising at least one die positioned on said second elastic membrane over said upper horizontal wall.

* * * * *